US008262366B2

(12) United States Patent
Simmons et al.

(10) Patent No.: US 8,262,366 B2
(45) Date of Patent: Sep. 11, 2012

(54) PISTON SYSTEMS HAVING A FLOW PATH BETWEEN PISTON CHAMBERS, PUMPS INCLUDING A FLOW PATH BETWEEN PISTON CHAMBERS, AND METHODS OF DRIVING PUMPS

(76) Inventors: Tom M. Simmons, Kamas, UT (US); John M. Simmons, Marion, UT (US); David M. Simmons, Francis, UT (US)

( * ) Notice: Subject to any disclaimer, the term of this patent is extended or adjusted under 35 U.S.C. 154(b) by 511 days.

(21) Appl. No.: 12/414,296

(22) Filed: Mar. 30, 2009

(65) Prior Publication Data

US 2010/0247334 A1 Sep. 30, 2010

(51) Int. Cl.
*F04B 49/03* (2006.01)
*F04B 49/02* (2006.01)

(52) U.S. Cl. ..... 417/53; 417/393; 417/395; 417/397

(58) Field of Classification Search ..... 417/53, 417/339, 341–343, 357, 368, 395
See application file for complete search history.

(56) References Cited

U.S. PATENT DOCUMENTS 4,386,888 A * 6/1983 Verley ..... 417/393
6,210,131 B1 * 4/2001 Whitehead ..... 417/397
6,874,997 B2 * 4/2005 Watanabe et al. ..... 417/395
7,458,309 B2 * 12/2008 Simmons et al. ..... 91/230

* cited by examiner

*Primary Examiner* — Joseph L Williams
*Assistant Examiner* — Nathaniel Lee
(74) *Attorney, Agent, or Firm* — TraskBritt

(57) ABSTRACT

Piston systems comprise a housing including a first piston chamber and a second piston chamber therein. A first piston is movably disposed within the first piston chamber and a second piston is movably disposed within the second piston chamber. A flow path extends between and couples the first piston chamber and the second piston chamber. Reciprocating pumps comprising a flow path between a plurality of piston chambers and methods of driving reciprocating pumps are also disclosed.

38 Claims, 5 Drawing Sheets

PISTON SYSTEMS HAVING A FLOW PATH BETWEEN PISTON CHAMBERS, PUMPS INCLUDING A FLOW PATH BETWEEN PISTON CHAMBERS, AND METHODS OF DRIVING PUMPS

TECHNICAL FIELD

The present invention relates generally to piston systems. More particularly, embodiments of the present invention relate to piston systems having a closed-loop flow path between two or more piston chambers, pumps including such structures, and methods of driving pumps.

BACKGROUND

Numerous industries and many applications utilize reciprocating pumps for transporting fluids. For example, reciprocating pumps are found in industries such as shipping, processing, manufacturing, irrigation, gasoline supply, air conditioning systems, flood control, marine services, etc. Conventional reciprocating pumps may employ one or more piston systems comprised of a plurality of pistons and associated piston chambers in driving the pump. Conventionally, as pistons displace longitudinally within the piston chamber, one or more volumes between the piston and the piston chamber increase or decrease, depending on the direction of longitudinal displacement. The increasing volumes must be filled with a fluid, such as air or other fluid, when the volume increases, and the fluid must subsequently be exhausted from the volume when the volume is decreased.

Conventional pumps have provided one or more vent lines, which may also be characterized as an exhaust port, which couple a volume of the piston chamber with the atmosphere surrounding the pump. One example of such a configuration is illustrated in FIGS. 1 and 2 in U.S. Pat. No. 7,458,309. As a shift piston displaces in a direction reducing the volume coupled to the vent line, a central body portion of the shift piston having substantially the same diameter as the interior of the piston chamber forces air through the vent line and into the surrounding atmosphere. Likewise, as the shift piston displaces in a direction increasing the volume coupled to the vent line, the central body portion of the shift piston pulls air into the piston chamber from the surrounding atmosphere.

Such piston systems are generally adequate for use in certain relatively benign environments. However, in some very abrasive environments, abrasive materials may enter into the exhaust ports and into the volume of the piston chamber, causing the piston and the piston chamber to wear at an increased rate. In other environments, chemicals or other materials in the surrounding atmosphere may enter into the exhaust ports and subsequently interfere with the motion of the pistons by causing the pistons to bind with and stick to the walls of their associated piston chamber or even to seize within the piston chamber.

BRIEF SUMMARY

Various embodiments of the present invention comprise piston systems including a closed-loop flow path to keep materials within the environment from entering into a piston chamber. In one or more embodiments, the piston system may include a housing comprising a first piston chamber and a second piston chamber therein. As used herein, the term "housing" does not denote a single component. The first piston chamber may comprise an aperture in a sidewall thereof and the second piston chamber may also comprise an aperture in a sidewall thereof. A first piston may be movably disposed within the first piston chamber and a second piston may be movably disposed within the second piston chamber. A flow path may extend between the aperture in the first piston chamber to the aperture in the second piston chamber to couple the first and second piston chambers.

Other embodiments comprise reciprocating pumps. In one or more embodiments, reciprocating pumps may comprise a housing comprising a first pressure chamber and a second pressure chamber therein. The first pressure chamber may be at least partially defined by a first flexible member. The second pressure chamber may be positioned within the housing opposing the first pressure chamber and may be at least partially defined by a second flexible member. A first shift piston may be disposed in a first shift piston chamber in the housing, and may be positioned proximate to the first flexible member. A second shift piston may be disposed in a second shift piston chamber in the housing, and may be positioned proximate to the second flexible member. A flow path may extend between the first piston chamber and the second piston chamber to couple a volume of the first piston chamber to a volume of the second piston chamber.

In one or more additional embodiments, reciprocating pumps may comprise a first shift piston chamber disposed in a housing and comprising a first longitudinal axis. A second shift piston chamber comprising a second longitudinal axis may be disposed in the housing and positioned with the second longitudinal axis laterally offset from the first longitudinal axis. A first shift piston may be movably positioned in the first shift piston chamber and proximate to a first flexible member at least partially defining a first pressure chamber. A second shift piston may be movably positioned in the second shift piston chamber and proximate to a second flexible member at least partially defining a second pressure chamber.

Still further embodiments comprise methods of driving a reciprocating pump. One or more embodiments of such methods may comprise filling a first pressure chamber within a housing with a control fluid to increase a volume of the first pressure chamber. The first pressure chamber may be at least partially defined by a first flexible member. The second pressure chamber may be at least partially defined by a second flexible member, and a volume thereof may be decreased as the volume of the first pressure chamber is increased. A first shift piston at least partially housed within a first shift piston chamber and positioned proximate the first flexible member may be displaced, decreasing a first volume of the first shift piston chamber. A second shift piston at least partially housed within a second shift piston chamber and positioned proximate the second flexible member may be displaced, increasing a second volume of the second shift piston chamber. At least a portion of a fluid from the first volume may be displaced into the second volume.

One or more additional embodiments of methods of driving reciprocating pumps may comprise filling a first pressure chamber within a housing with a control fluid to increase a volume of the first pressure chamber. The first pressure chamber may be at least partially defined by a first flexible member. The second pressure chamber may be at least partially defined by a second flexible member, and a volume thereof may be decreased as the volume of the first pressure chamber is increased. A first shift piston at least partially housed within a first piston chamber and positioned proximate the first flexible member may be displaced. A volume of a second shift piston chamber may be at least partially filled with the control fluid. A second shift piston at least partially housed within the second shift piston chamber and positioned proximate the second flexible member may be displaced.

DETAILED DESCRIPTION

The illustrations presented herein are, in some instances, not actual views of any particular piston system or pump assembly, but are merely idealized representations which are employed to describe the present invention. Additionally, elements common between figures may retain the same numerical designation.

Figure 1:
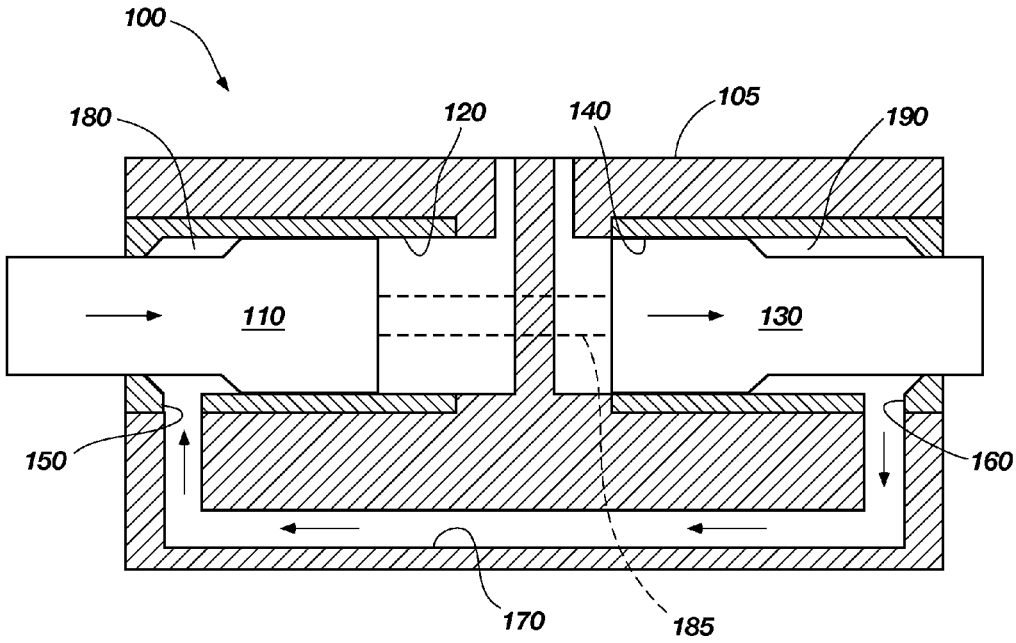
FIG. 1 illustrates a cross-sectional view of a piston system according to at least some embodiments of the present invention and as a plurality of pistons thereof are displaced from left to right.

Various embodiments of the present invention comprise piston systems comprising a closed-loop flow path. Referring to FIG. 1, a piston system 100 may comprise a housing 105 at least substantially enclosing a first piston 110 disposed within a first piston chamber 120 and a second piston 130 disposed within a second piston chamber 140. In at least some embodiments, the housing 105 may comprise at least a portion of a reciprocating pump assembly, and, as noted above, may not comprise a single component. The piston system 100 is configured so that the first piston 110 and second piston 130 move in relation to each other. For example, when the first piston 110 is displaced from left to right, the second piston 130 is also displaced from left to right. The first piston chamber 120 comprises an aperture 150 in a sidewall thereof and in communication with a first volume 180 of the first piston chamber 120. Similarly, the second piston chamber 140 comprises an aperture 160 in the sidewall thereof in communication with a second volume 190 of the second piston chamber 140. A flow path 170 is positioned to extend between the aperture 150 in the first piston chamber 120 and the aperture 160 in the second piston chamber 140. In at least some embodiments, the flow path 170 may comprise a channel formed entirely within the housing 105 to couple the first volume 180 to the second volume 190.

As stated above, the first piston 110 and second piston 130 are configured to move in relation to each other. For example, the first piston 110 and second piston 130 may be fixed relative to each other. In some embodiments, a shaft 185, as depicted in broken lines, may be positioned between the first piston 110 and second piston 130 in some embodiments. In other embodiments, the first piston 110 and second piston 130 may be coupled to one or more structures outside the illustrated housing 105, which one or more structures may be configured or fixed relative to the first piston 110 and second piston 130 to move the first piston 110 and second piston 130 in relation to each other.

In operation, the first piston 110 may be displaced from left to right, as shown in FIG. 1. As the first piston 110 is forced rightward, the second piston 130 is also forced rightward. The first volume 180 between the first piston 110 and a portion of the first piston chamber 120 increases, forming a negative pressure or a vacuum within the volume 180. Similarly, as the second piston 130 moves rightward in relation to the movement of the first piston 110, the second volume 190 between the second piston 130 and a portion of the second piston chamber 140 decreases, which produces a positive pressure as a fluid therein is compressed. The flow path 170 extending through the housing 105 between the first volume 180 and the second volume 190 provides a path for a fluid therein to move from the high pressure second volume 190 to the low pressure first volume 180 as denoted by the arrows in FIG. 1. In other words, as the second piston 130 is forced rightward, a fluid within the second volume 190 is forced out from the second volume 190, through the flow path 170 and into the first volume 180.

Figure 2:
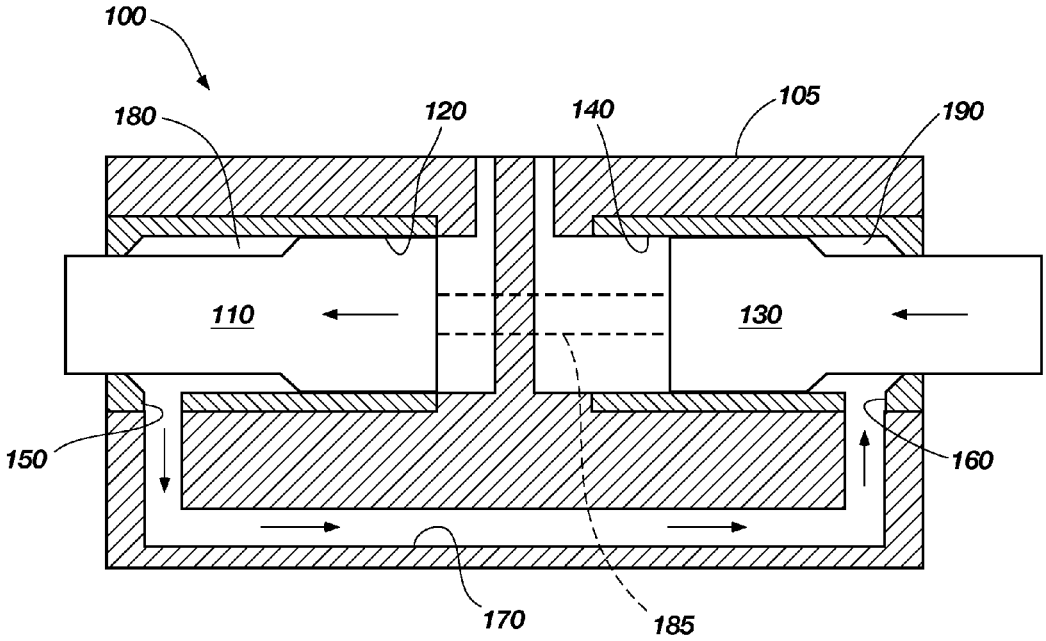
FIG. 2 is a cross-sectional view of the piston system of FIG. 1 as the plurality of pistons are displaced from right to left.

FIG. 2 illustrates the displacement of the first piston 110 and second piston 130 in the opposite direction, from right to left. As the first piston 110 is forced leftward, the second piston 130 is also forced leftward. The first volume 180 between the first piston 110 and a portion of the first piston chamber 120 decreases, and a fluid therein is forced out from the first volume 180 through the flow path 170 as denoted by the arrows in FIG. 2 and into the second volume 190, which increases as the second piston 130 is displaced leftward.

Figure 3:
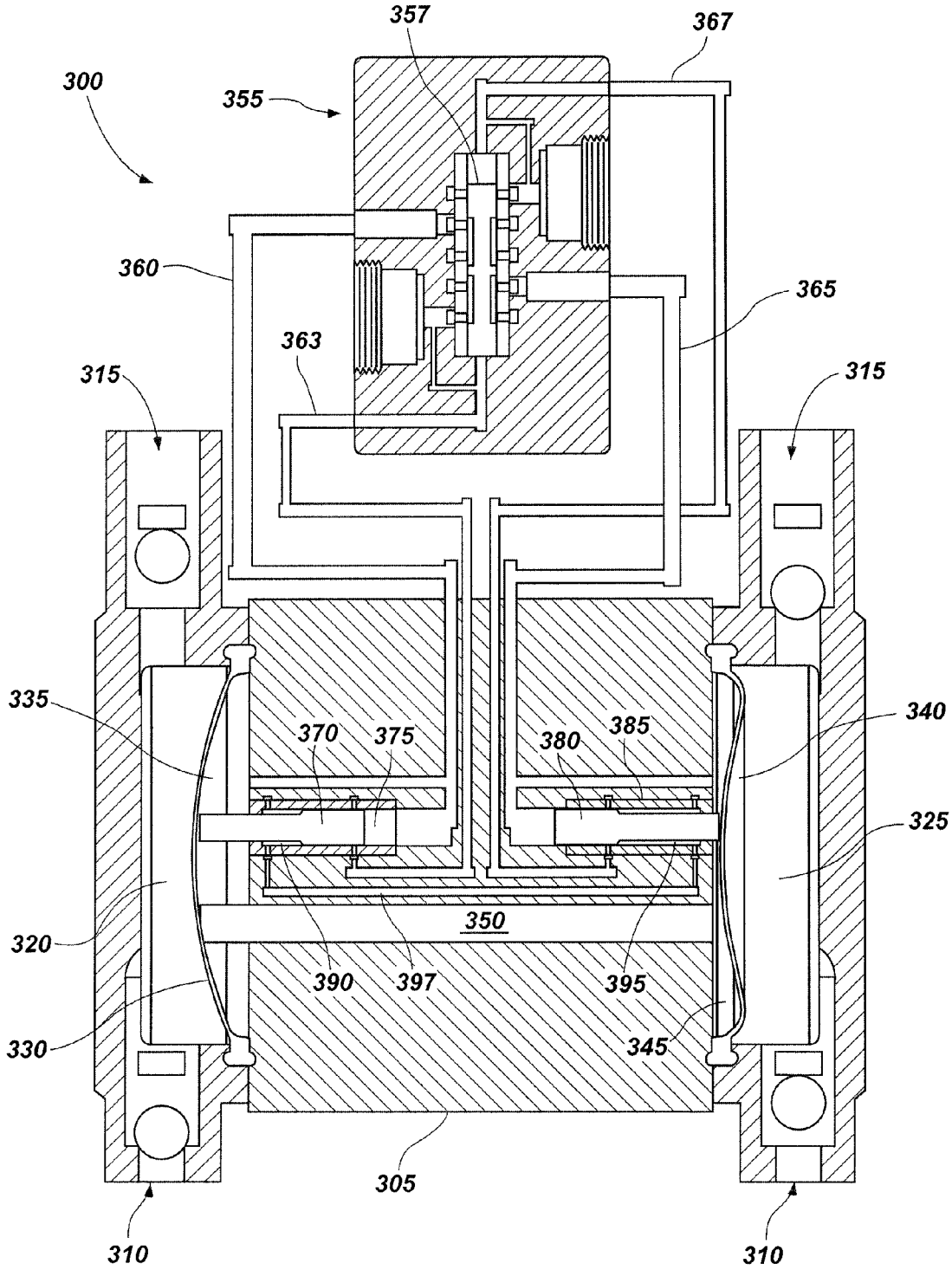
FIG. 3 illustrates a schematic view of a pump assembly according to at least one embodiment of the present invention.
Figure 4:
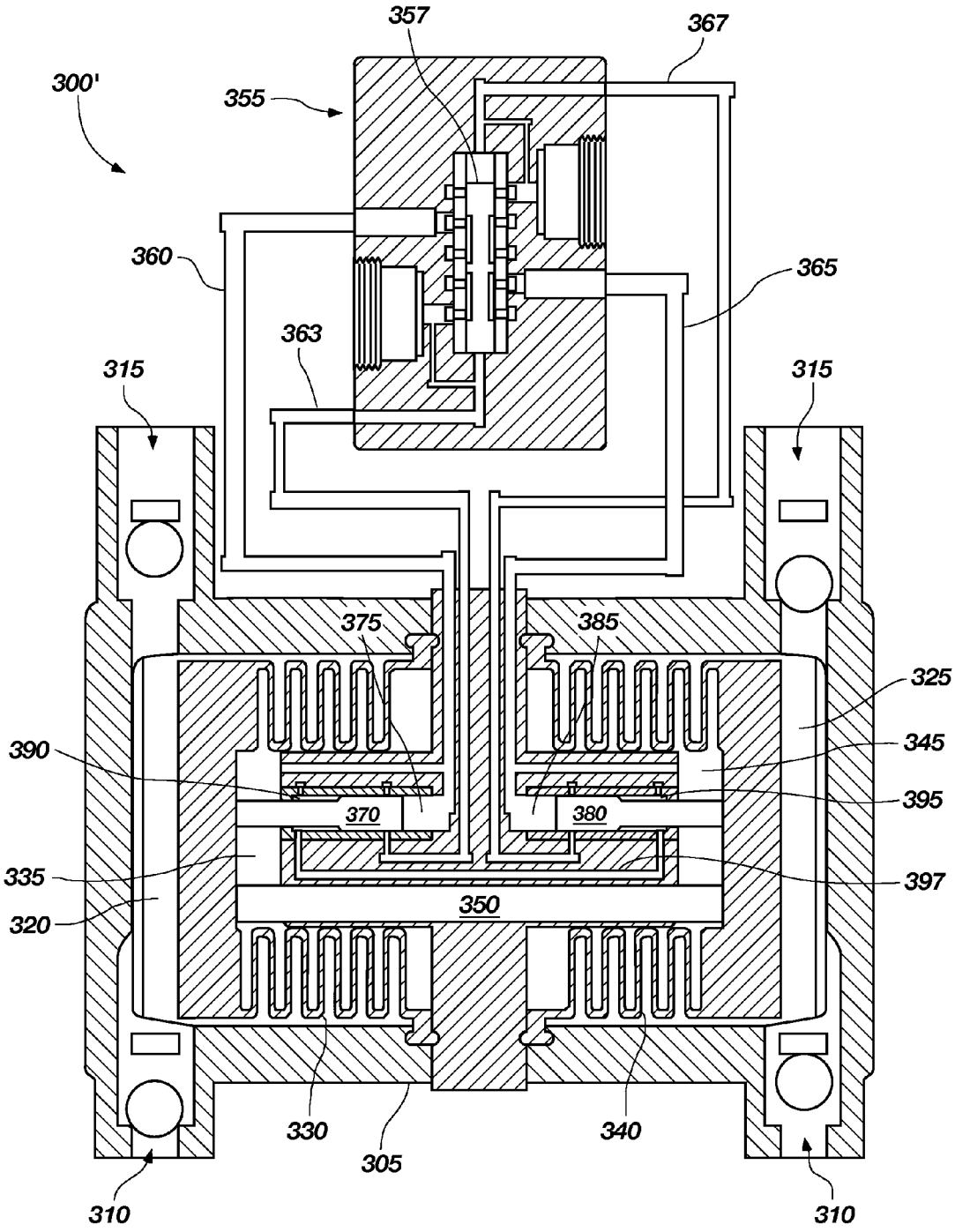
FIG. 4 is a schematic view of a pump assembly according to at least one other embodiment of the present invention.

Piston systems according to various embodiments of the present invention may be employed in a plurality of applications. By way of example and not limitation, various embodiments of pump assemblies may employ embodiments of a piston system of the present invention. FIGS. 3 and 4 illustrate schematic views of various embodiments of pump assemblies comprising a piston system according to embodiments of the present invention. A pump 300 (FIG. 3) or 300' (FIG. 4) may be configured as a reciprocating pump and may be generally symmetrically configured through a midpoint of a housing 305. With reference to FIG. 3, the housing 305 may comprise an integral structure in some embodiments, or the housing 305 may comprise a plurality of structures coupled together. The pump 300 includes at least one fluid inlet port 310 and at least one fluid outlet port 315. The at least one fluid inlet port 310 and the at least one fluid outlet port 315 may be in communication with a first fluid chamber 320 and a second fluid chamber 325. Fluid may be drawn into the first fluid chamber 320 through the fluid inlet port 310 in communication with the first fluid chamber 320, and expelled from the second fluid chamber 325 through the fluid outlet port 315 in communication with the second fluid chamber 325. The at least one fluid inlet port 310 and the at least one fluid outlet port 315 may be operable by one-way valves, which may be characterized as check valves. One suitable example of a one-way valve includes a resiliently biased ball valve, which may prevent mixing of the fluid being drawn into the pump 300 and the fluid being expelled from the pump 300. Thus, the first fluid chamber 320 and the second fluid chamber 325 may receive a volume of fluid through the at least one fluid inlet port 310 and dispose a volume of fluid through the at least one fluid outlet port 315.

The volume in the first fluid chamber 320 may be controlled by a first flexible member 330. The first flexible member 330 in FIG. 3 comprises a diaphragm that forms a first pressure chamber 335. The term "flexible member" applies to members constructed entirely of a flexible material, as well as members having rigid portions as well as flexible portions, such as the bellows depicted in FIG. 4. Any member or combination of members capable of forming an expandable and contractable chamber is within the scope of the present invention.

A flow of a control fluid, for example pressurized air, into the first pressure chamber 335 may cause the first pressure chamber 335 to expand, and the first flexible member 330 to move leftward, reducing the volume of the first fluid chamber 320 and forcing the fluid out the fluid outlet port 315. Likewise, a second flexible member 340 forming a second pressure chamber 345 may control the volume of a second fluid chamber 325. The first flexible member 330 and the second flexible member 340 may be fixed relative to one another with a shaft 350. As the first flexible member 330 is forced leftward by the flow of control fluid into the first pressure chamber 335, the second flexible member 340 may be pulled leftward by the shaft 350. As a consequence, the volume of the second fluid chamber 325 may increase, and the volume of the second pressure chamber 345 may decrease. Thus, fluid may be drawn into the second fluid chamber 325 through the fluid inlet port 310.

The pump 300 is depicted as configured with the fluid chambers 320, 325 positioned outward and the pressure chambers 335, 345 positioned relatively inward of the fluid chambers 320, 325. However, other configurations are also contemplated, including having the fluid chambers 320, 325 positioned inward and the pressure chambers 335, 345 positioned relatively outward, such as the pump disclosed in U.S. Pat. No. 7,458,309, the disclosure of which is incorporated herein in its entirety by this reference.

The first flexible member 330 and the second flexible member 340 may be attached to the shaft 350, such that both a pushing and a pulling force on either flexible member 330, 340 may be translated through the shaft 350. In other embodiments, the first flexible member 330 and the second flexible member 340 may merely abut the ends of the shaft 350, such that a pushing force may be translated from one flexible member to the other via the shaft 350. Such a configuration, in which the first flexible member 330 and the second flexible member 340 abut the ends of the shaft 350, is more suitable to pumps having the fluid chambers positioned inward and the pressure chambers positioned relatively outward, as referred to above. Although the shaft 350 is depicted in FIGS. 3 and 4 as positioned near a lower portion of the first and second flexible members 330, 340, such configuration is not intended to be limiting. Indeed, in some embodiments, the shaft 350 may be positioned at least substantially centrally against the flexible members to reduce bending and torsional forces on the flexible members.

A first supply and exhaust line 360 may be coupled to the first pressure chamber 335 and configured to provide a control fluid to the first pressure chamber 335 to fill the first pressure chamber 335 with control fluid and increase the volume thereof, as well as to provide means for the exhaust of a control fluid therein when the volume thereof is decreased. Likewise, a second supply and exhaust line 365 is coupled to the second pressure chamber 345. Although the supply and exhaust lines 360, 365 are depicted as the same line for both control fluid supply and exhaust, in other embodiments the control fluid supply line may be separate and distinct from the control fluid exhaust line.

At the end of a stroke, the control fluid must feed into the pressure chamber of the other side of the pump in order to initiate the next stroke. In some embodiments, a spool valve 355 may be used to shift the supply of control fluid between the first supply and exhaust line 360 and the second supply and exhaust line 365. The spool valve 355 may include a shuttle spool 357 therein as are known to those of ordinary skill in the art. The position of the shuttle spool 357, and thus the supply of control fluid, may be shifted by a pulse of control fluid through conduits 363, 367 or other methods such as electronic actuation. The spool valve 355 is configured such that when the control fluid is supplied through the first supply and exhaust line 360 to fill the first pressure chamber 335, air may be exhausted simultaneously from the second pressure chamber 345 through the second supply and exhaust line 365.

The shuttle spool 357 of the spool valve 355 may be shifted by a pulse of control fluid provided at a longitudinal end of the shuttle spool 357, which may displace the shuttle spool 357 in a longitudinal direction. A plurality of shift pistons may control the delivery of the pulse of control fluid to the longitudinal ends of the shuttle spool. U.S. Pat. No. 7,458,309, which was referenced above and the disclosure thereof incorporated herein, discloses an embodiment and operation of a suitable example for a spool valve 355 and a plurality of shift pistons suitable for use in implementation of some embodiments of the present invention. The plurality of shift pistons may be configured as a piston system according to embodiments of the present invention.

Generally, a first shift piston 370 may be positioned within a first shift piston chamber 375 disposed at least partially within the housing 305. The first shift piston 370 is positioned with one longitudinal end proximate to the first flexible member 330 and an opposing longitudinal end in communication with the first supply and exhaust line 360. When the first pressure chamber 335 is filled with control fluid, the control fluid may also enter a portion of the first shift piston chamber 375, displacing the first shift piston 370 adjacent the first flexible member 330. Likewise, a second shift piston 380 may be positioned within a second shift piston chamber 385 with one longitudinal end proximate to the second flexible member 340 and an opposing longitudinal end in communication with the second supply and exhaust line 365.

When the first shift piston 370 is displaced sufficiently leftward (as oriented in FIG. 3) in conjunction with the first pressure chamber 335, the first shift piston 370 extends beyond the portion of the first shift piston chamber 375 in communication with the first conduit 363. The control fluid may then enter and flow through the first conduit 363 and flow to the longitudinal end of the shuttle spool 357, displacing the shuttle spool 357 in a longitudinal direction.

When the first shift piston 370 is displaced respectively rightward or leftward (as oriented in FIG. 3), a first volume 390 is expanded or contracted. The first volume 390 comprises a volume between the first shift piston 370 and the first shift piston chamber 375, which is isolated from the first supply and exhaust line 360. Similarly, a second volume 395 is contracted or expanded upon respective rightward and leftward displacement of the second shift piston 380, the second volume 395 comprising a volume between the second shift piston 380 and the second shift piston chamber 385, which is isolated from the second supply and exhaust line 365. The first volume 390 and the second volume 395 are coupled together through a flow path 397. The flow path 397 may comprise a channel formed within, and fully enclosed by the housing 305 to couple the first volume 390 to the second volume 395. As the first shift piston 370 and first pressure chamber 335 are displaced by the control fluid, the first volume 390 decreases and a fluid in the first volume 390 is displaced through the flow path 397 and into the second volume 395.

In operation, the volume of the first pressure chamber 335 may be increased by filling the first pressure chamber 335 with the control fluid entering from the first supply and exhaust line 360. Control fluid from the first supply and exhaust line 360 may also enter the first shift piston chamber 375. The control fluid within the first shift piston chamber 375 may force a first shift piston 370 against a surface of the first flexible member 330 facing the first pressure chamber 335. Control fluid entering the first pressure chamber 335 and the first shift piston chamber 375 forces the first shift piston 370 and the first flexible member 330 to displace to the left (in the embodiment shown in FIG. 3), increasing the volume of the first pressure chamber 335 and decreasing the volume of both the first fluid chamber 320 and the first volume 390. Fluid within the first fluid chamber 320 is forced out the fluid outlet port 315, and fluid within the first volume 390 is forced out to the flow path 397.

As the first flexible member 330 is forced leftward by the control fluid, the shaft 350 is displaced leftward, and the second flexible member 340 is pulled leftward by the shaft 350 and the second shift piston 380 is pushed leftward by a surface of the second flexible member 340 against which the second shift piston 380 abuts. The volume of both the second fluid chamber 325 and the second volume 395 increases, and the volume of the second pressure chamber 345 decreases. Control fluid within the second pressure chamber 345 is forced out of a second supply and exhaust line 365 as a fluid is forced into the second fluid chamber 325 through the fluid inlet port 310. The second volume 395 fills with at least a portion of the fluid forced out to the flow path 397 from the first volume 390.

With reference to FIG. 4, in which like elements retain like numerical designation, the housing 305 may comprise an integral structure in some embodiments, or the housing 305 may comprise a plurality of structures coupled together. The pump 300' includes at least one fluid inlet port 310 and at least one fluid outlet port 315. The at least one fluid inlet port 310 and the at least one fluid outlet port 315 may be in communication with a first fluid chamber 320 and a second fluid chamber 325. Fluid may be drawn into the first fluid chamber 320 through the fluid inlet port 310 in communication with the first fluid chamber 320, and expelled from the second fluid chamber 325 through the fluid outlet port 315 in communication with the second fluid chamber 325. The at least one fluid inlet port 310 and the at least one fluid outlet port 315 may be operable by one-way valves, which may be characterized as check valves. One suitable example of a one-way valve includes a resiliently biased ball valve, which may prevent mixing of the fluid being drawn into the pump 300' and the fluid being expelled from the pump 300'. Thus, the first fluid chamber 320 and the second fluid chamber 325 may receive a volume of fluid through the at least one fluid inlet port 310 and dispose a volume of fluid through the at least one fluid outlet port 315.

The volume in the first fluid chamber 320 may be controlled by a first flexible member 330. The first flexible member 330 of pump 300' comprises a bellows, which forms a first pressure chamber 335. A flow of a control fluid, for example pressurized air, into the first pressure chamber 335 may cause the first pressure chamber 335 to expand, and the first flexible member 330 to move leftward, reducing the volume of the first fluid chamber 320 and forcing the fluid out the fluid outlet port 315. Likewise, a second flexible member 340 forming a second pressure chamber 345 may control the volume of a second fluid chamber 325. The first flexible member 330 and the second flexible member 340 may be fixed relative to one another with a shaft 350. As the first flexible member 330 is forced leftward by the flow of control fluid into the first pressure chamber 335, the second flexible member 340 may be pulled leftward by the shaft 50. As a consequence, the volume of the second fluid chamber 325 may increase, and the volume of the second pressure chamber 345 may decrease. Thus, fluid may be drawn into the second fluid chamber 325 through the fluid inlet port 310.

The pump 300' is configured with the fluid chambers 320, 325 positioned outward and the pressure chambers 335, 345 positioned relatively inward of the fluid pressure chambers 320, 325. However, similar to the embodiment shown in FIG. 3, other configurations are also contemplated, including having the fluid chambers 320, 325 positioned inward and the pressure chambers 335, 345 positioned relatively outward, such as the pump disclosed in U.S. Pat. No. 7,458,309.

The first flexible member 330 and the second flexible member 340 may be attached to the shaft 350, such that both a pushing and a pulling force on either flexible member 330, 340 may be translated through the shaft 350. In other embodiments, the first flexible member 330 and the second flexible member 340 may merely abut the ends of the shaft 350, such that a pushing force may be translated from one flexible member to the other via the shaft 350. Such a configuration, in which the first flexible member 330 and the second flexible member 340 abut the ends of the shaft 350, is more suitable to pumps having the fluid chambers positioned inward and the pressure chambers positioned relatively outward, as referred to above.

A first supply and exhaust line 360 may be coupled to the first pressure chamber 335 and configured to provide a control fluid to the first pressure chamber 335 to fill the first pressure chamber 335 with control fluid and increase the volume thereof, as well as to provide means for the exhaust of a control fluid therein when the volume thereof is decreased. Likewise, a second supply and exhaust line 365 is coupled to the second pressure chamber 345. Although the supply and exhaust lines 360, 365 are depicted as the same line for both control fluid supply and exhaust, in other embodiments the control fluid supply line may be separate and distinct from the control fluid exhaust line.

At the end of a stroke, the control fluid must feed into the pressure chamber of the other side of the pump in order to initiate the next stroke. In some embodiments, a spool valve 355 may be used to shift the supply of control fluid between the first supply and exhaust line 360 and the second supply and exhaust line 365. The spool valve 355 may include a shuttle spool 357 therein as is known to those of ordinary skill in the art. The position of the shuttle spool 357, and thus the supply of control fluid, may be shifted by a pulse of control fluid through conduits 363, 367 or other methods such as electronic actuation. The spool valve 355 is configured such that when the control fluid is supplied through the first supply and exhaust line 360 to fill the first pressure chamber 335, air may be exhausted simultaneously from the second pressure chamber 345 through the second supply and exhaust line 365.

The shuttle spool 357 of the spool valve 355 may be shifted by a pulse of control fluid provided at a longitudinal end of the shuttle spool 357, which may displace the shuttle spool 357 in a longitudinal direction. A plurality of shift pistons may control the delivery of the pulse of control fluid to the longitudinal ends of the shuttle spool 357. The plurality of shift pistons may be configured as a piston system according to embodiments of the present invention.

When the first shift piston 370 is displaced sufficiently leftward (as oriented in FIG. 4) in conjunction with the first pressure chamber 335, the first shift piston 370 extends beyond the portion of the first shift piston chamber 375 in communication with the first conduit 363. The control fluid may then enter and flow through the first conduit 363 and flow to the longitudinal end of the shuttle spool 357, displacing the shuttle spool 357 in a longitudinal direction.

Generally, a first shift piston 370 may be positioned within a first shift piston chamber 375 disposed at least partially within the housing 305. The first shift piston 370 is positioned with one longitudinal end proximate to the first flexible member 330 and an opposing longitudinal end in communication with the first supply and exhaust line 360. When the first pressure chamber 335 is filled with control fluid, the control fluid may also enter a portion of the first shift piston chamber 375, displacing the first shift piston 370 adjacent the first flexible member 330. Likewise, a second shift piston 380 may be positioned within a second shift piston chamber 385 with one longitudinal end proximate to the second flexible member 340 and an opposing longitudinal end in communication with the second supply and exhaust line 365.

When the first shift piston 370 is displaced respectively rightward or leftward (as oriented in FIG. 4), a first volume 390 is expanded or contracted. The first volume 390 comprises a volume between the first shift piston 370 and the first shift piston chamber 375, which is isolated from the first supply and exhaust line 360. Similarly, a second volume 395 is contracted or expanded upon respective rightward and leftward displacement of the second shift piston 380, the second volume 395 comprising a volume between the second shift piston 380 and the second shift piston chamber 385, which is isolated from the second supply and exhaust line 365. The first volume 390 and the second volume 395 are coupled together through a flow path 397. The flow path 397 may comprise a channel formed within, and fully enclosed by the housing 305 to couple the first volume 390 to the second volume 395. As the first shift piston 370 and first pressure chamber 335 are displaced by the control fluid, the first volume 390 decreases and a fluid in the first volume 390 is displaced through the flow path 397 and into the second volume 395.

In operation, the volume of the first pressure chamber 335 may be increased by filling the first pressure chamber 335 with the control fluid entering from the first supply and exhaust line 360. Control fluid from the first supply and exhaust line 360 may also enter the first shift piston chamber 375. The control fluid within the first shift piston chamber 375 may force the first shift piston 370 against a surface of the first flexible member 330 facing the first pressure chamber 335. Control fluid entering the first pressure chamber 335 and the first shift piston chamber 375 forces the first shift piston 370 and the first flexible member 330 to displace to the left (in the embodiment shown in FIG. 4), increasing the volume of the first pressure chamber 335 and decreasing the volume of both the first fluid chamber 320 and the first volume 390. Fluid within the first fluid chamber 320 is forced out the fluid outlet port 315, and fluid within the first volume 390 is forced out to the flow path 397.

As the first flexible member 330 is forced leftward by the control fluid, the shaft 350 is displaced leftward, and the second flexible member 340 is pulled leftward by the shaft 350 and the second shift piston 380 is pushed leftward by a surface of the second flexible member 340 against which the second shift piston 380 abuts. The volume of both the second fluid chamber 325 and the second volume 395 increases, and the volume of the second pressure chamber 345 decreases. Control fluid within the second pressure chamber 345 is forced out of a second supply and exhaust line 365 as a fluid is forced into the second fluid chamber 325 through the fluid inlet port 310. The second volume 395 fills with at least a portion of the fluid forced out to the flow path 397 from the first volume 390.

By coupling the first volume 390 and second volume 395 with the flow path 397, the shift pistons 370, 380 and shift piston chambers 375, 385 are substantially closed to the surrounding environment. Thus, contaminants and corrosive materials are unable to fill any portion of the first volume 390 or the second volume 395. In addition, by coupling the first volume 390 and second volume 395, the movement of the two shift pistons 370, 380 may be more stable since the fluid being forced out from one volume to the other also aids in displacing the shift piston located adjacent the volume receiving the fluid.

As set forth herein, various embodiments of the pumps 300, 300' may be configured with the fluid chambers 320, 325 positioned outward and the pressure chambers 335, 345 positioned relatively inward as well as the opposite, in which the fluid chambers 320, 325 are positioned inward and the pressure chambers 335, 345 are positioned relatively outward. In addition, various embodiments of the pumps 300, 300' may be configured with the shift pistons 370, 380 positioned relatively inward from the flexible members 330, 340, as shown in FIGS. 3 and 4. Other embodiments of the pumps 300, 300' may be configured with the shift pistons 370, 380 positioned relatively outward from the flexible members 330, 340, as depicted in the pump disclosed in U.S. Pat. No. 7,458,309.

Figure 5:
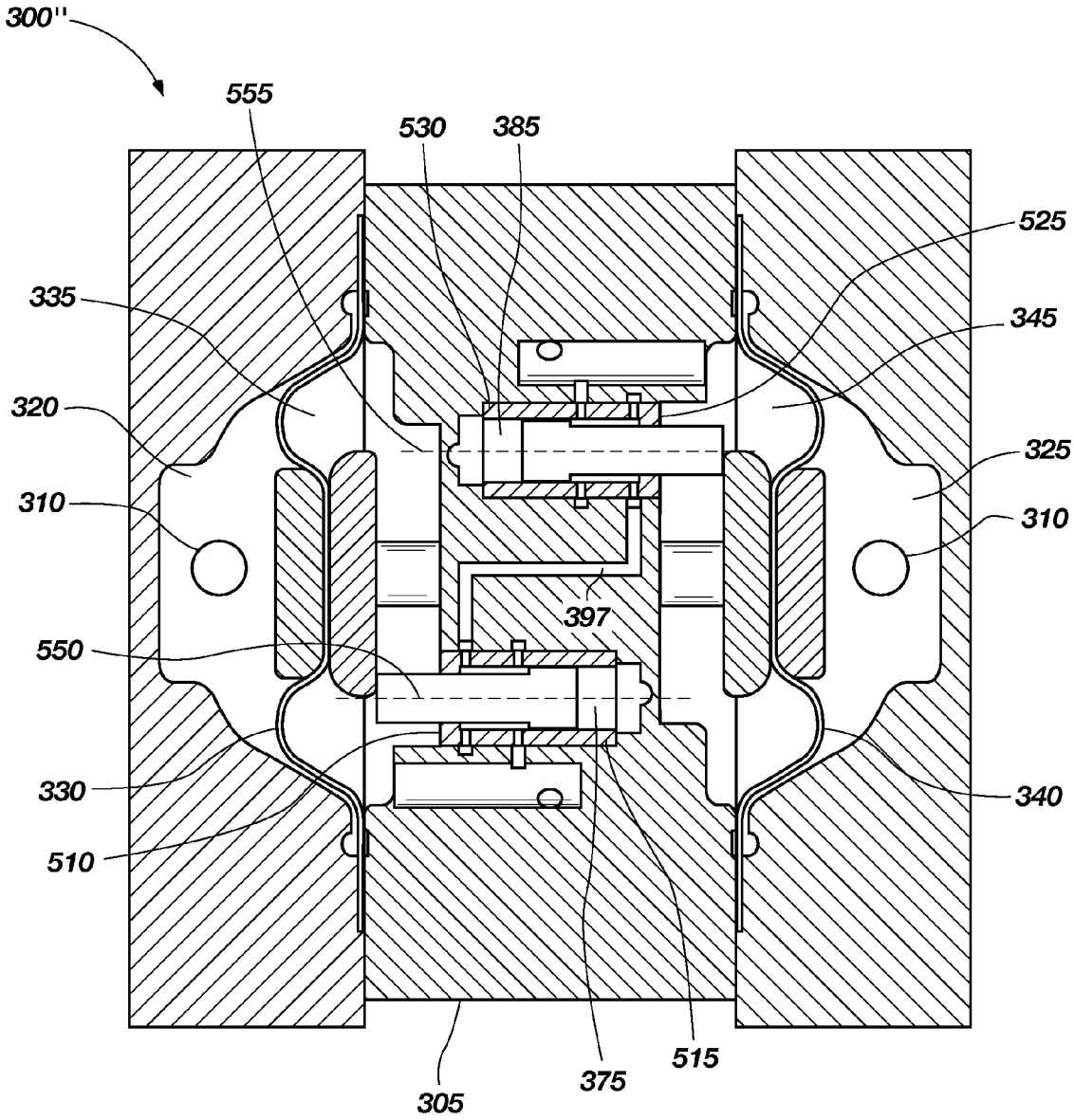
FIG. 5 is a schematic depiction illustrating a cross-sectional top view of a portion of a pump comprising a first shift piston chamber and a second shift piston chamber positioned laterally offset according to at least one embodiment.

In the pumps 300, 300', the shift piston chambers 375, 385 are configured to be axially aligned within the housing 305. In other embodiments, the shift piston chambers 375, 385 may be laterally offset, as well as partially overlapping. FIG. 5 is a schematic depiction illustrating a cross-sectional top view of a portion of a pump 300" comprising a first shift piston chamber 375 and second shift piston chamber 385 positioned laterally offset according to some embodiments. The first shift piston chamber 375 and second shift piston chamber 385 are positioned laterally offset and partially overlapping in the housing 305. The first shift piston chamber 375 may be positioned with a first longitudinal end 510 positioned in communication with the first pressure chamber 335 and extending longitudinally to a second longitudinal end 515 positioned toward the second flexible member 340. Similarly, the second shift piston chamber 385 may be positioned with a first longitudinal end 525 in communication with the second pressure chamber 345 and extending longitudinally to a second longitudinal end 530 positioned toward the first flexible member 330. A first longitudinal axis 550 of the first shift piston chamber 375 may be offset, which may also be characterized as nonaligned, from the second longitudinal axis 555 of the second shift piston chamber 385.

In at least some embodiments, a second longitudinal end 515 of the first shift piston chamber 375 may be positioned to overlap the second longitudinal end 530 of the second shift piston chamber 385. In other words, the second longitudinal end 515 of the first shift piston chamber 375 may be located closer to the second flexible member 340 than the second longitudinal end 530 of the second shift piston chamber 385. Likewise, the second longitudinal end 530 of the second shift piston chamber 385 may be located closer to the first flexible member 330 than the second longitudinal end 515 of the first shift piston chamber 375. In at least some embodiments, the second longitudinal end 515 of the first shift piston chamber 375 may be located proximate the second pressure chamber 345, and the second longitudinal end 530 of the second shift piston chamber 385 may be located proximate the first pressure chamber 335.

In such embodiments, the overall size of the housing 305 may be reduced while the capacity of the pump remains unchanged. For example, with the shift piston chambers 375, 385 configured as described with relation to FIG. 5, the housing 305 may be made more compact, but the stroke length of the flexible members 330, 340 remains unchanged. With the stroke length of the flexible members 330, 340 remaining unchanged, the fluid chambers 320, 325 can still achieve the same maximum volume, while the overall size of the pump 300" is substantially reduced.

Figure 6:
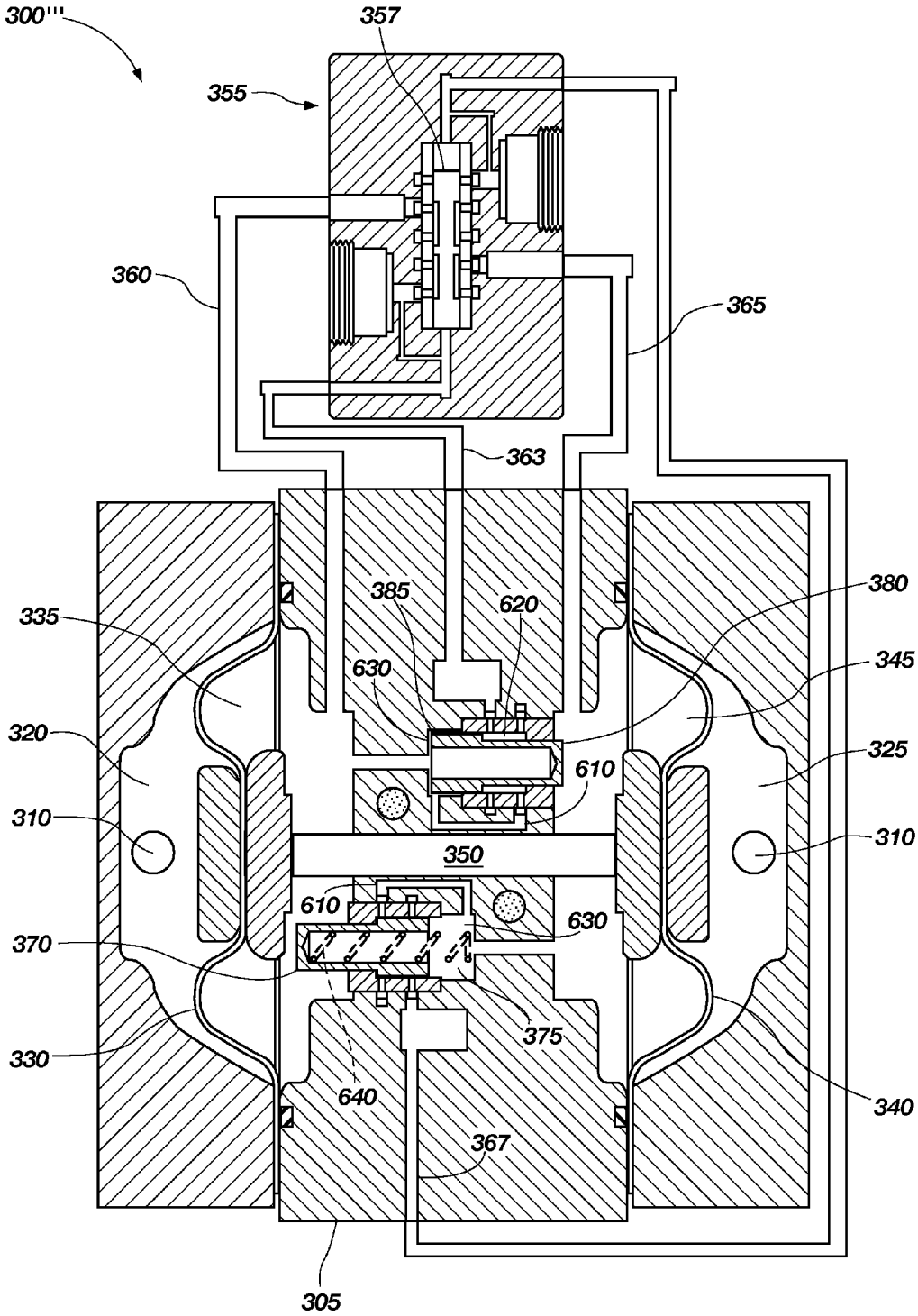
FIG. 6 is a schematic depiction illustrating a cross-sectional top view of a portion of a pump according to at least one embodiment.

The pumps 300 and 300' illustrate embodiments configured so that when control fluid is provided to a pressure chamber 335, 345, control fluid is also provided to the associated shift piston chamber 375, 385. For example, in the embodiment of FIG. 3, the first supply and exhaust line 360 is associated with both the first pressure chamber 335 and the first shift piston chamber 375, to force the first shift piston 370 against a surface of the first flexible member 330. In other embodiments, a pump may be configured to provide control fluid to a pressure chamber and to a piston chamber not associated with the pressure chamber. FIG. 6 illustrates a schematic view of a pump assembly 300'" according to at least one such embodiment. The pump 300'" is configured similar to the pump 300", having offset shift piston chambers 375, 385. The first shift piston chamber 375 is in communication with the second supply and exhaust line 365, either directly or through the second pressure chamber 345. According to some embodiments, the first shift piston chamber 375 may be characterized as comprising a first longitudinal end in communication with the first pressure chamber 335, and a second longitudinal end in communication with the second pressure chamber 345, either directly or by means of the second supply and exhaust line 365. Similarly, the second shift piston chamber 385 is coupled to and in communication with the first supply and exhaust line 360, either directly or through the first pressure chamber 335. According to at least some embodiments, the second shift piston chamber 385 may be characterized as comprising a first longitudinal end in communication with the second pressure chamber 345, and a second longitudinal end in communication with the first pressure chamber 335, either directly or by means of the first supply and exhaust line 360.

In the embodiment shown in FIG. 6, the first shift piston chamber 375 and second shift piston chamber 385 may each comprise a flow path 610 extending between and coupling portions of the shift piston chambers 375, 385 comprising volumes separated by the respective first and second shift pistons 370, 380. The first shift piston chamber 375 and the second shift piston chamber 385 each comprise a flow path 610 extending between and coupling a first chamber volume 620 and a second chamber volume 630. In other embodiments, the flow path 610 may extend between and couple the first chamber volume 620 directly to a pressure chamber 335, 345 or to a supply and exhaust line 360, 365. For example, a flow path 610 may be coupled to and extend between the first chamber volume 620 of the first shift piston chamber 375 and one or both of the second pressure chamber 345 and the second supply and exhaust line 365.

In operation, the volume of the first pressure chamber 335 may be increased by filling the first pressure chamber 335 with the control fluid entering from the first supply and exhaust line 360. Control fluid from the first supply and exhaust line 360 may also enter the second shift piston chamber 385. The control fluid within the second shift piston chamber 385 may force a second shift piston 380 against a surface of the second flexible member 340 facing the second pressure chamber 345, or, in some embodiments, against a surface of the second piston chamber 385. Control fluid entering the first pressure chamber 335 and the second shift piston chamber 385 forces the first flexible member 330 to displace to the left and the second shift piston 380 to displace to the right (in the embodiment shown in FIG. 6), increasing the volume of the first pressure chamber 335 and decreasing the volume of the first fluid chamber 320.

As the first flexible member 330 is forced leftward by the control fluid, the shaft 350 is displaced leftward, and the second flexible member 340 is pulled leftward by the shaft 350. As the second flexible member 340 is displaced leftward, the second shift piston 380 may be pushed leftward by a portion of a surface of the second flexible member 340 against which the second shift piston 380 may abut. The volume of both the second fluid chamber 325 and the first chamber volume 620 increases, and the volume of the second pressure chamber 345 decreases. Control fluid within the second pressure chamber 345 is forced out of a second supply and exhaust line 365 as a fluid is forced into the second fluid chamber 325 through the fluid inlet port 310. The first chamber volume 620 fills with control fluid flowing through the flow path 610 from the second chamber volume 630, which is in communication with the first supply and exhaust line 360.

When the second shift piston 380 is displaced a sufficient distance leftward, a portion of the first conduit 363 in communication with the second chamber volume 630 is exposed. The control fluid may then flow from the first pressure chamber 335 and the second chamber volume 630 through the flow path 610, into the first chamber volume 620 and out through the first conduit 363. The control fluid flowing through the first conduit 363 may flow to the longitudinal end of the shuttle spool 357, displacing the shuttle spool 357 in a longitudinal direction and shifting the flow of the control fluid from the first supply and exhaust line 360 to the second supply and exhaust line 365.

The flow of control fluid through the second supply and exhaust line 365 fills the second pressure chamber 345 and increases the volume thereof by forcing the second flexible member 340 to displace to the right. Control fluid from the second supply and exhaust line 365 may also enter the first shift piston chamber 375, displacing the first shift piston 370 to the left, against a surface of the first flexible member 330 or against a surface of the first shift piston chamber 375. The control fluid may enter the first shift piston chamber 375 either directly from the second supply and exhaust line 365, or by means of the second pressure chamber 345.

As the second flexible member 340 is forced rightward by the control fluid, the shaft 350 is displaced rightward, and the first flexible member 330 is pulled rightward by the shaft 350. The first shift piston 370 may be pushed rightward by a portion of a surface of the first flexible member 330 against which the first shift piston 370 may abut. The volume of the first fluid chamber 320 increases, and the volume of the first pressure chamber 335 decreases. Control fluid within the first pressure chamber 335 is forced out of the first supply and exhaust line 360 as a fluid is forced into the first fluid chamber 320 through the fluid inlet port 310. The first chamber volume 620 of the first shift piston chamber 375 fills with control fluid flowing through the flow path 610 from the second chamber volume 630 of the first shift piston chamber 375, which is in communication with the second supply and exhaust line 365. The first chamber volume 620 of the first shift piston chamber 375 is not shown in FIG. 6 since the first shift piston 370 is shown displaced all the way to the left and the first chamber volume 620 is essentially completely filled by the first shift piston 370.

When the first shift piston 370 is displaced a sufficient distance rightward, the portion of the second conduit 367 in communication with the first chamber volume 620 is exposed. The control fluid may then flow from the second pressure chamber 345 and the second chamber volume 630 through the flow path 610, into the first chamber volume 620 and out through the second conduit 367. The control fluid flowing through the second conduit 367 may flow to the longitudinal end of the shuttle spool 357, displacing the shuttle spool 357 in a longitudinal direction and shifting the flow of the control fluid from the second supply and exhaust line 365 to the first supply and exhaust line 360.

In at least some embodiments, a spring 640 may be positioned in a portion of a shift piston chamber and located to displace, or aid in displacing a shift piston longitudinally within the shift piston chamber. In at least some embodiments, the spring 640 may displace the shift piston toward the flexible member with which the shift piston is associated. For example, FIG. 6 shows the first shift piston chamber 375 comprising an optional spring 640 depicted by broken lines and located in the first shift piston chamber 375 to displace the first shift piston 370 leftward. In at least some embodiments, the spring 640 may be positioned between a portion of the first shift piston chamber 375 and the first shift piston 370. Similarly, a spring 640 may be positioned between a portion of the second shift piston chamber 385 and the second shift piston 380. In this manner, the first shift piston 370 may be displaced by the spring 640 so as to inhibit a flow of the control fluid into the first conduit 363. When the first flexible member 330 is displaced rightward, a surface thereof may contact the first shift piston 370 and may displace the first shift piston 370 rightward, causing the spring 640 to compress. By way of example and not limitation, the spring 640 may be utilized in applications employing control fluid at lower pressures, the spring 640 aiding in displacing the shift pistons when the control fluid pressure is inadequate to displace the shift pistons. However, use of the spring 640 is not limited to such applications.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. A piston system, comprising:

a housing comprising a first piston chamber and a second piston chamber therein, wherein the first piston chamber comprises an aperture in a sidewall thereof and the second piston chamber comprises an aperture in a sidewall thereof;

a first shift piston movably disposed within the first piston chamber;

a second shift piston movably disposed within the second piston chamber;

a flow path extending between the aperture of the first piston chamber and the aperture of the second piston chamber; and a valve configured to deliver a control fluid to at least one of the first piston chamber and the second piston chamber and configured to change a flow path in response to a change in a position of at least one of the first shift piston and the second shift piston.

2. The piston system of claim 1, wherein the flow path is formed entirely within the housing.

3. The piston system of claim 1, wherein the housing comprises a pump assembly housing.

4. The piston system of claim 1, wherein the first shift piston and the second shift piston are associated to move in relation to each other.

5. The piston system of claim 4, wherein the first shift piston and the second shift piston are fixed relative to each other.

6. The piston system of claim 1, wherein only a portion of the flow path is enclosed within the housing.

7. A reciprocating pump, comprising:

a housing;

a first pressure chamber within the housing, the first pressure chamber at least partially defined by a first flexible member;

a second pressure chamber within the housing and opposing the first pressure chamber, the second pressure chamber at least partially defined by a second flexible member;

a first shift piston disposed in a first shift piston chamber in the housing, the first shift piston positioned proximate to the first flexible member;

a second shift piston disposed in a second shift piston chamber in the housing, the second shift piston positioned proximate to the second flexible member;

a flow path extending between and coupling a volume of the first shift piston chamber and a volume of the second shift piston chamber; and a valve configured to deliver a control fluid to at least one of the first shift piston chamber and the second shift piston chamber and configured to change a flow path in response to a change in a position of at least one of the first shift piston and the second shift piston.

8. The reciprocating pump of claim 7, further comprising:

a first fluid chamber having a volume at least partially controllable by a position of the first flexible member; and a second fluid chamber having a volume at least partially controllable by a position of the second flexible member;

wherein the first pressure chamber and the second pressure chamber are positioned in the housing relatively inward from the first fluid chamber and the second fluid chamber.

9. The reciprocating pump of claim 7, further comprising:

a first fluid chamber having a volume at least partially controllable by a position of the first flexible member; and a second fluid chamber having a volume at least partially controllable by a position of the second flexible member;

wherein the first pressure chamber and the second pressure chamber are positioned in the housing relatively outward from the first fluid chamber and the second fluid chamber.

10. The reciprocating pump of claim 7, wherein the first flexible member and the second flexible member each comprise a diaphragm.

11. The reciprocating pump of claim 7, wherein the first flexible member and the second flexible member each comprise a bellows.

12. The reciprocating pump of claim 7, wherein the flow path is entirely enclosed within the housing.

13. The reciprocating pump of claim 7, further including a spool valve for shifting a supply of control fluid between the first pressure chamber and the second pressure chamber.

14. The reciprocating pump of claim 7, wherein the first shift piston chamber is laterally offset from the second shift piston chamber with a first longitudinal axis of the first shift piston chamber nonaligned with a second longitudinal axis of the second shift piston.

15. The reciprocating pump of claim 14, further comprising:

a first longitudinal end of the first shift piston chamber in communication with the first pressure chamber and a second longitudinal end of the first shift piston chamber toward the second flexible member; and a first longitudinal end of the second shift piston chamber in communication with the second pressure chamber and a second longitudinal end of the second shift piston chamber toward the first flexible member;

wherein the second longitudinal end of the first shift piston chamber is located closer to the second flexible member than the second longitudinal end of the second shift piston chamber.

16. The reciprocating pump of claim 14, further comprising:

a first longitudinal end of the first shift piston chamber in communication with the first pressure chamber and a second longitudinal end of the first shift piston chamber in communication with the second pressure chamber; and a first longitudinal end of the second shift piston chamber in communication with the second pressure chamber and a second longitudinal end of the second shift piston chamber in communication with the first pressure chamber.

17. The reciprocating pump of claim 7, further comprising:

a spring disposed in the first shift piston chamber and positioned to displace the first shift piston within the first shift piston chamber; and another spring disposed in the second shift piston chamber and positioned to displace the second shift piston within the second shift piston chamber.

18. A reciprocating pump, comprising:

a first shift piston chamber disposed in a housing and comprising a first longitudinal axis;

a second shift piston chamber comprising a second longitudinal axis and disposed in the housing and positioned with the second longitudinal axis laterally offset from the first longitudinal axis;

a first shift piston movably positioned in the first shift piston chamber and proximate to a first flexible member at least partially defining a first pressure chamber;

a second shift piston movably positioned in the second shift piston chamber and proximate to a second flexible member at least partially defining a second pressure chamber;

a valve configured to deliver a control fluid to at least one of the first shift piston chamber and the second shift piston chamber and configured to change a flow path in response to a change in a position of at least one of the first shift piston and the second shift piston; and a flow path extending between and coupling a volume of the first shift piston chamber and a volume of the second shift piston chamber.

19. The reciprocating pump of claim 18, wherein the flow path is entirely enclosed within the housing.

20. The reciprocating pump of claim 18, further comprising:

a first longitudinal end of the first shift piston chamber in communication with the first pressure chamber and a second longitudinal end of the first shift piston chamber toward the second flexible member; and a first longitudinal end of the second shift piston chamber in communication with the second pressure chamber and a second longitudinal end of the second shift piston chamber toward the first flexible member;

wherein the second longitudinal end of the first shift piston chamber is located closer to the second flexible member than the second longitudinal end of the second shift piston chamber.

21. The reciprocating pump of claim 18, wherein the first shift piston chamber is in communication with the second pressure chamber, and the second shift piston chamber is in communication with the first pressure chamber.

22. The reciprocating pump of claim 18, wherein the first flexible member and the second flexible member each comprise a diaphragm.

23. The reciprocating pump of claim 18, wherein the first flexible member and the second flexible member each comprise a bellows.

24. The reciprocating pump of claim 18, further comprising:

a spring positioned between a portion of the first shift piston chamber and the first shift piston; and another spring positioned between a portion of the second shift piston chamber and the second shift piston.

25. A method of driving a reciprocating pump, comprising:

filling a first pressure chamber within a housing and at least partially defined by a first flexible member with a control fluid and increasing a volume of the first pressure chamber;

decreasing a volume of a second pressure chamber within the housing at least partially defined by a second flexible member;

displacing a first shift piston at least partially housed within a first shift piston chamber and decreasing a first volume of the first shift piston chamber;

displacing a second shift piston at least partially housed within a second shift piston chamber within the housing and positioned proximate the second flexible member and increasing a second volume of the second shift piston chamber;

displacing at least a portion of a fluid from the first shift piston chamber into the second shift piston chamber through a flow path coupling the first shift piston chamber and the second shift piston chamber; and changing a flow path of the control fluid through a valve in response to a change in a position of the first shift piston.

26. The method of claim 25, wherein decreasing the volume of the second pressure chamber comprises pulling the second flexible member with a shaft affixed to the first flexible member and to the second flexible member.

27. The method of claim 25, wherein decreasing the volume of the second pressure chamber comprises pushing the second flexible member with a shaft adjacent to the first flexible member and to the second flexible member.

28. The method of claim 25, further comprising configuring each of the first flexible member and the second flexible member as a diaphragm.

29. The method of claim 25, further comprising configuring each of the first flexible member and the second flexible member as a bellows.

30. The method of claim 25, wherein displacing at least a portion of a fluid from the first shift piston chamber into the second shift piston chamber through a flow path coupling the first shift piston chamber and the second shift piston chamber comprises displacing at least a portion of a fluid from the first shift piston chamber into the second shift piston chamber through a flow path entirely enclosed by the housing.

31. The method of claim 25, wherein displacing the first shift piston comprises displacing the first shift piston with a spring positioned within at least a portion of the first shift piston chamber.

32. The method of claim 25, wherein displacing the first shift piston comprises filling the first shift piston chamber with the control fluid to at least partially fill the volume of the first shift piston chamber.

33. A method of driving a reciprocating pump, comprising:

filling a first pressure chamber within a housing and at least partially defined by a first flexible member with a control fluid and increasing a volume of the first pressure chamber;

decreasing a volume of a second pressure chamber within the housing at least partially defined by a second flexible member;

displacing a first shift piston at least partially housed within a first shift piston chamber and positioned proximate the first flexible member;

at least partially filling a volume of a second shift piston chamber with the control fluid, at least a portion of the control fluid passing through a flow path coupling the first shift piston chamber and the second shift piston chamber;

displacing a second shift piston at least partially housed within the second shift piston chamber and positioned proximate the second flexible member; and changing a flow path of the control fluid through a valve in response to a change in a position of the first shift piston.

34. The method of claim 33, wherein decreasing the volume of the second pressure chamber comprises pulling the second flexible member with a shaft affixed to the first flexible member and to the second flexible member.

35. The method of claim 33, wherein decreasing the volume of the second pressure chamber comprises pushing the second flexible member with a shaft adjacent to the first flexible member and to the second flexible member.

36. The method of claim 33, further comprising configuring each of the first flexible member and the second flexible member as a diaphragm.

37. The method of claim 33, further comprising configuring each of the first flexible member and the second flexible member as a bellows.

38. The method of claim 33, wherein displacing the first shift piston comprises displacing the first shift piston at least partially with a spring positioned within at least a portion of the first shift piston chamber.

* * * * *